US005487257A

United States Patent [19]

Domeier et al.

[11] Patent Number: 5,487,257

[45] Date of Patent: Jan. 30, 1996

[54] PACKING AND UNPACKING MACHINE

[75] Inventors: Bernhard Domeier, Pentling; Dieter Rumm, Schwandorf, both of Germany

[73] Assignee: Krones AG, Neutraubling, Germany

[21] Appl. No.: 166,689

[22] Filed: Dec. 14, 1993

[30] Foreign Application Priority Data

Dec. 19, 1992 [DE] Germany ..... 42 43 008.9

[51] Int. Cl.[6] ..... B65B 35/30

[52] U.S. Cl. ..... 53/539; 53/534; 53/247; 53/251; 414/416; 414/736

[58] Field of Search ..... 414/416, 736; 53/167, 251, 201, 202, 448, 492, 381.1, 253, 382.1, 246, 247, 534, 539

[56] References Cited

U.S. PATENT DOCUMENTS

| | | | |
|---|---|---|---|
| 3,185,328 | 5/1965 | Dardaine et al. | 53/539 X |
| 3,517,831 | 6/1970 | Hahn | 53/539 X |
| 3,587,888 | 6/1971 | Warren | 414/416 X |
| 3,780,492 | 12/1973 | Corderoy | 53/539 X |
| 3,948,018 | 4/1976 | Rowekamp | 53/539 X |
| 4,569,181 | 2/1986 | Raudat | 53/539 X |
| 4,793,762 | 12/1988 | Munch et al. | 414/416 |
| 5,257,888 | 11/1993 | Kronseder | 53/247 X |

FOREIGN PATENT DOCUMENTS

| | | | |
|---|---|---|---|
| 1087967 | 8/1960 | Germany | 53/247 |
| 1179855 | 10/1964 | Germany | 53/251 |
| 1900083 | 8/1970 | Germany . | |
| 2460957 | 6/1976 | Germany . | |
| 2460958 | 6/1976 | Germany | 53/247 |
| 3826785 | 7/1989 | Germany . | |
| 4125573A1 | 5/1992 | Germany . | |

*Primary Examiner*—John Sipos
*Assistant Examiner*—Daniel Moon
*Attorney, Agent, or Firm*—Ryan, Maki & Hohenfeldt

[57] ABSTRACT

A conveyor conveys boxes that are empty and boxes that are filled with articles in a horizontal plane past an article handling machine where articles of a first type are removed from some boxes and articles of a second type are inserted in empty boxes. The machine runs concurrently with the box conveyor in one direction so boxes from which the articles of the first type are conveyed beyond the machine and empty boxes in which articles of the second type are inserted are also conveyed from the machine in the same direction. The article handling machine has heads that are constrained to orbit in a generally circular path and the heads have grippers on them which are controllable to grip and release groups of articles at consecutive working stations along the orbital path of the heads.

10 Claims, 2 Drawing Sheets

PACKING AND UNPACKING MACHINE

BACKGROUND OF THE INVENTION

The invention disclosed herein pertains to a machine for inserting groups of articles into containers and concurrently removing groups of articles from other containers and sending the removed articles and containers with other articles to separate destinations.

Continuously operating machines that are dedicated to packing articles, such as filled and crowned beverage bottles, into containers such as cases, cartons or crates or are dedicated to unpacking of articles such as empty returnable bottles from containers are known as, for example, in German patent specification DE OS 41 25 573. These individual, but continuously operating, machines have replaced the earlier widely used intermittently operating machines. It has been recognized as disadvantageous, however, that such individually dedicated machines can be used either, only as packers that insert articles in containers, or as unpackers that withdraw articles from containers. In beverage filling production lines, this requires two separate packing machines that are each compatible, insofar as speed is concerned, with other operations in the production line. In connection with intermittently operating packing machines, consideration has been given to performing packing and unpacking in a single machine as demonstrated in German Patent Application DE OS 24 60 957, but no one heretofore has implemented performing both basic functions in a continuously operating single machine. As indicated, individual machines that handle articles and containers intermittently are considered obsolete because they are incompatible with continuously operating production lines.

SUMMARY OF THE INVENTION

The objective achieved by the invention disclosed herein is the provision of a compact machine which can simultaneously pack containers or unpack containers continuously at high speeds.

The term "box" as used herein is, for the sake of brevity, to be construed as a generic term for various kinds of containers including, but not limited to crates, cases, cartons and the like. The term "bottle", as used herein, is intended to be generic to articles of first and second types or any types such as, but not limited to, empty returned and reusable bottles and filled and crowned bottles, respectively.

According to the invention, a bottle handling machine is arranged adjacent a longitudinally extending box conveyor. The bottle handling machine has orbiting bottle handling heads on which there are controllable bottle grippers. The heads travel in a closed loop in alignment with and above a box conveyor. A bottle conveyor has an infeed section driven translationally in the same direction as the box conveyor for feeding filled and crowned bottles that are to be packed into empty boxes on the box conveyor and has a discharge conveyor section for discharging articles such as empty returned bottles that are withdrawn from boxes between the infeed and discharge conveyor, there is an intermediate space free from apparatus that could interfere with the movement of the heads. This arrangement permits an orbital path of travel for the bottle handling heads which traverse three operating stations at which the bottle gripping elements of the bottle handling heads are controlled to grip groups of empty bottles or to release groups of full bottles or vice-versa.

One alternative operating mode is wherein empty boxes are conveyed on the box conveyor and alternately boxes containing empty bottles that are to be withdrawn from the boxes are conducted horizontally past the orbital path of the bottle handling heads such that a head, lowered onto an empty box inserts bottles in boxes, that is, operates as a packer while the next consecutive head operates as an unpacker for removing bottles from conveyed boxes. In a packing machine with an even number of orbiting bottle or article handling heads, an individual head always operates only as a packing head or as an unpacking head during a machine cycle. In a machine having an odd number of bottle handling heads, however, the gripping elements of an individual head are controlled in such a way that each bottle handling head can operate in one cycle as a packing head and in a following cycle as an unpacking head.

A more productive mode of operation is, however, having boxes filled with empty bottles that are to be unpacked conveyed on one of two separate tracks on the box conveyor while boxes into which filled bottles are to be inserted are conveyed on an adjacent track in phase with each other. In this arrangement, each bottle handling head has two separate but contiguous and similar groups of gripping elements where one group of gripping elements is allocated to empty boxes coming to the machine, and the second group is allocated to boxes filled with bottles that are to be unpacked as conveyed away from the machine.

A more detailed description of an embodiment of the invention and how the objectives and features discussed above are implemented will now be set forth in reference to the accompanying drawings.

DESCRIPTION OF A PREFERRED EMBODIMENT

Figure 1:
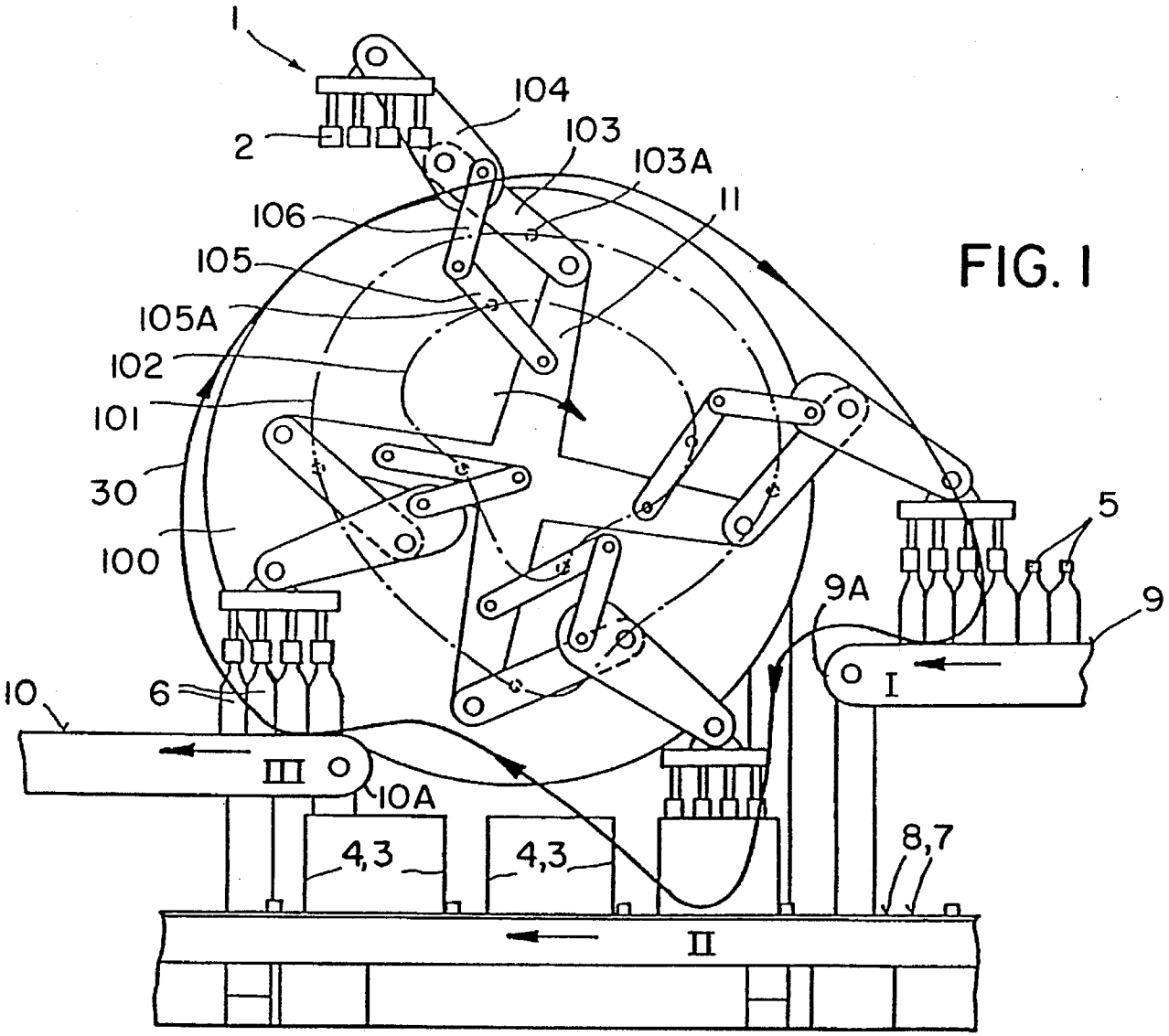
FIG. 1 shows a side elevational view of the unitary packing and unpacking machine.
Figure 2:
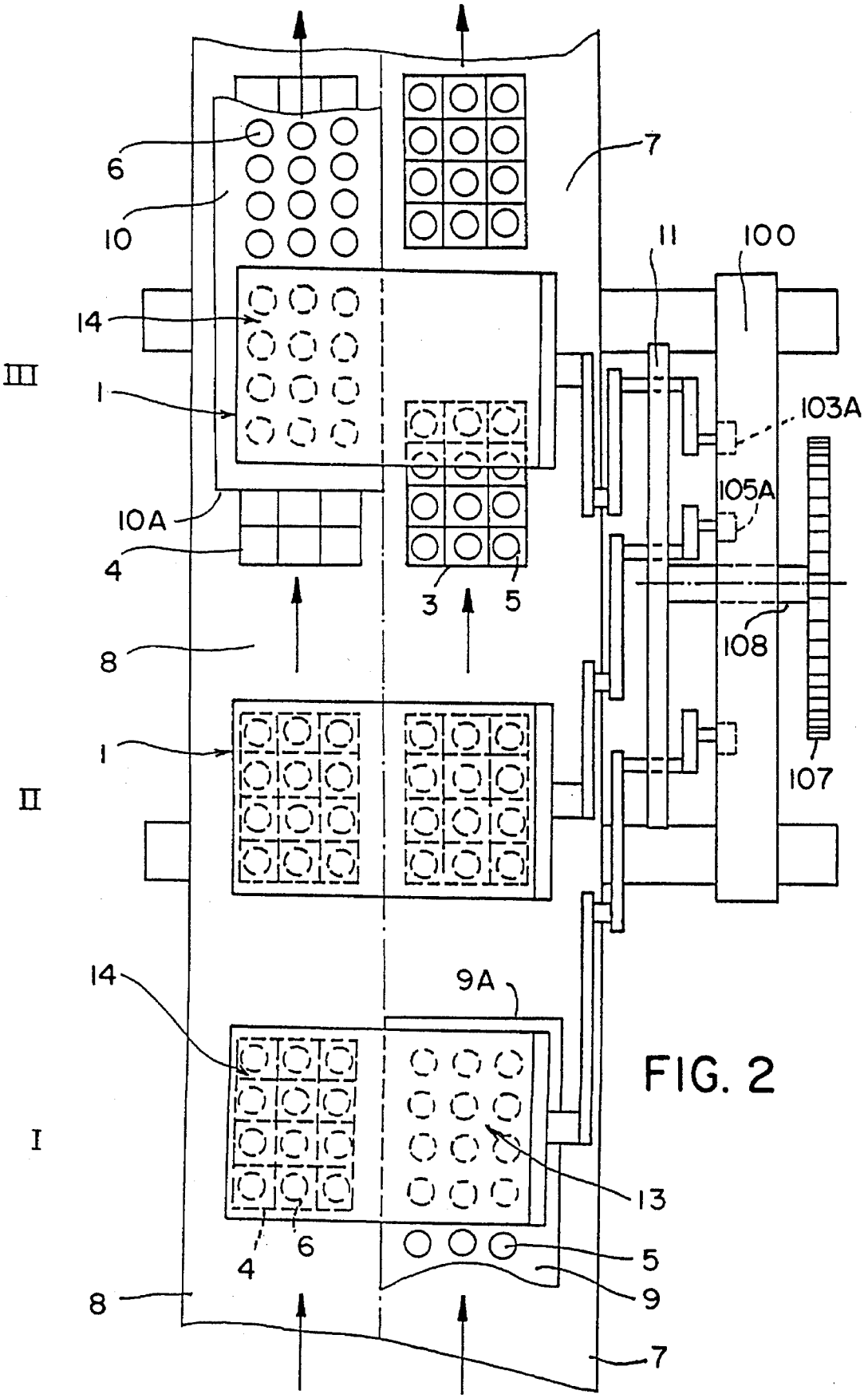
FIG. 2 is a schematic top plan view of the machine depicted in FIG. 1.

The machine represented in FIGS. 1 and 2 is designed for packing or inserting groups of filled beverage bottles into boxes and for unpacking or withdrawing the full complement of returned and empty bottles out of boxes. The empty bottles may be sent on their way to a washing machine and the boxes containing filled and crowned bottles may be sent to the beginning of a distribution channel in which they ultimately are purchased by consumers.

As is shown in FIG. 1, the box conveyor belt 7,8 transports the boxes 3,4 horizontally with a uniform spacing between them past the packing machine. FIG. 2 discloses that the box conveyor has two parallel running paths in which empty boxes 3 on conveyor 7 come in, for example, from a box washing machine, and boxes for containing empty bottles come in on conveyor 8 from a depalleting machine, not shown, for example. The boxes 3, 4 are conveyed into the machine region adjacent one another. The incoming filled bottles 5 that are to be packed into empty boxes 3 are brought in by the bottle infeeder conveyor 9 running horizontally above conveyor 7. The reference character 9A indicates where conveyor 9 ends over conveyor belt 7,8. FIG. 1 shows that the filled bottle infeed conveyor 9 is at an elevation above conveyor 7. In FIG. 1, one may see that there is an empty bottle group 6 discharge conveyor 10 laterally offset from filled bottle infeeder conveyor 9 but advanced from the latter in the longitudinal direction of conveyor translation. Empty bottle group 6 discharge conveyor 10 is also at an elevation above its cooperating track 8 on the box conveyor. Discharge conveyor 10 begins where reference character 10A is applied. Thus, there is a substantial amount of space, free of mechanism that could interfere with the heads 1, between filled bottle infeeder 9 and empty bottle group 6 discharge conveyor 10.

The schematically represented bottle handling heads 1 in FIG. 2 each have two groups of gripping elements 2 mounted to them. These groups are designated in FIG. 1 where one may see that there are twelve gripping elements in one group 13 and twelve in another group 14 on head 1. In FIG. 2, only the foreground group of gripper elements 14 is visible. As is evident in FIG. 2, the first group of gripper elements 13 are allocated to filled and crowned bottles 5 which are to be packed into clean boxes 3 in alignment with filled bottle feeder 9 and empty box conveyor 7. The second group of gripper elements is allocated to empty bottles 6 which are to be unpacked from boxes 4. The gripping element groups 13 and 14 are operable independently of one another between bottle gripping conditions and bottle releasing conditions and vice-versa.

Attention is now invited to FIG. 1 for a description of the manner in which the bottle handling heads are driven in a generally orbital path 30 around a horizontal axis. The mechanism comprises a rotor member 11 which is driven rotationally about a horizontal axis and rotates in the direction indicated by the arrow overlying the rotor member. Rotor 11 has four arms, and each arm has a group of links attached to it. The most radially outboard arm 104 pivotally connects to a bottle handling head 1 with the twenty-four gripping heads 2 directed downwardly. The gripping heads are always directed downwardly because they pendulate on link 104. Other links are identified by the reference numerals 103, 106, and 105A. The rotor 11 and links carried thereon rotate or orbit relative to a circular stationary member 100 in which there are two cam tracks indicated by dashed-dot closed loops 101 and 102. Each of the links 103 carry a cam roller 103A and each of the links 105 carry a cam roller 105A. The cam rollers and the cams cooperate in a manner that results in a head 1 being positioned where it should be at a time when it is to pick up or release a group of bottles.

The orbital travel path 30 of the bottle handling heads 1 is seen in FIG. 1 to pass through 3 working positions designated by the roman numerals I, II and III. At each one of the working stations, the two groups of gripping elements 2 in the two groups of elements 13 and 14 on a head are controlled to alternate between gripping and grip releasing positions or vice-versa. The working station I is allocated to the filled bottle infeeder 9, working station II to the box conveyors 7,8 and working station III to the empty bottle group discharge conveyor 10.

In an actual embodiment, each bottle handling head 1 is provided with a mechanical arrangement, which ensures that the bottle handling heads 1 will maintain a true horizontal position during their transit through their generally orbital or circulation path 30.

An operating cycle of the bottle handling heads will be described as starting when the head 1 arrives at station I where it is lowered to proximity with the filled bottle infeeder conveyor 9. Here, the grippers 2 are controlled or actuated to grip a group of filled and crowned bottles 5 which are presently at an elevation above conveyor the track of 7 which transports the clean empty boxes 3 into the machine. In one continuous motion, bottle handling head 1 at station I lifts the bottles 5 that are to be inserted in boxes from filled bottle infeeder conveyor 9 and deposits them in an empty box 3 on translating box conveyor 7. As the head 1 reaches the lowermost position in station II. The second group of twelve gripping elements 2 on head 1 is lowered onto the empty returned bottles 6 that are to be withdrawn from box 4 which is coming in on the track of conveyor 8 concurrently or in phase with the box 3 into which bottles 5 have been deposited. As the group of gripping elements 13 are released when the filled bottles 5 are deposited in box 3 on conveyor 7, the other group of gripping elements 14 on the same head 1 are controlled to grip the twelve empty return bottles 6 in the box 4. Continuously with these two events, the bottle handling head 1 is moving forward and is also being raised as indicated by the path outlined by the arrowheaded line 30. Because the packing head 1 rises after departing from station II, the group of gripping elements on the head withdraw the empty bottles from box 4 and in the region of working station III on the bottle discharge conveyor 10 the empty bottle group 6 is deposited on discharge conveyor 10 for being conducted away from the machine. When the empty bottles 4 were lifted out of the box 6 in which they were conveyed into the machine the resulting empty box 4 simply continues to be conveyed away on conveyor track 8. On the other hand, the box 3 in which the filled bottles 5 were inserted at station 2 was released from the head and continues being conveyed on conveyor 7 to an appropriate destination. When the empty bottles 6 are deposited at station III on the discharge conveyor 10, the gripping elements 2 are controlled to release the bottles so that they can continue as a group on conveyor 10. In the region of the three working stations I, II and III, the bottle handling heads run synchronously with the conveying speed of the conveyor belts or of the box conveyors.

In a variation of the machine represented in FIG. 2, the bottle infeed conveyor 9 and the bottle discharge conveyor 10 can be constructed as 2 parallel tracks with a box conveyor running underneath, in which case it is possible for the machine to be operated temporarily with double packing or unpacking performance as a high production packer or unpacker, alternatively. A precondition is that the control of the gripping elements 2 has to be appropriately sequenced. Then, for example, at the start of operation of the bottle filling production line the machine can operate first with two tracks only as an unpacking machine and after filling of the buffer stretches which are usually present in such lines and of the bottle washing machine, the filling machine goes over into the combined packing and unpacking mode. At the end of operation, then, the machine can be operated for faster emptying of the buffer stretch.

An advantage of the invention is that the packing and unpacking machine can be arranged on one side beside the bottle and box conveying conveyors while the opposite side remains accessible to operating personnel.

We claim:

1. Apparatus for removing first articles from boxes and for inserting second articles into boxes continuously, comprising:

A box conveyor for conveying a first stream of boxes containing first articles and a second, parallel stream of boxes which are empty, a machine arranged proximate to the box conveyor and comprised of plural article handling heads connected to the machine and transported continuously in a closed loop path through working stations with the heads extending laterally over said box conveyor, said heads having gripping elements individually controllable to grip and release articles, an article infeed conveyor providing second articles to a first working station along the path of the continuously moving heads where gripping elements of a head are controlled to grip the second articles and hold the second articles while the head is continuously moved to a second working station where said gripping elements are controlled to release the second articles into an empty box in the second stream of boxes and other of the gripping elements on the head are controlled to concurrently grip and withdraw first articles from a box in the first stream of boxes while the head is continuously moved to a third working station to carry said first articles above the box conveyor and allow the resulting empty box in the first stream and the box in which the second articles were inserted in the second stream to be conveyed together on the box conveyor, and an outfeed conveyor at said third working station to which the first articles that are withdrawn from a box at the second working station are carried by the gripping elements of the head and are released onto the outfeed conveyor for being conveyed, away from the machine.

2. Apparatus according to claim 1 wherein said article infeed conveyor for infeed of said second articles at said first working station is positioned at an elevation above the elevation of the box conveyor.

3. Apparatus according to claim 1 wherein said outfeed conveyor is at an elevation above the elevation of said box conveyor.

4. Apparatus according to claim 1 wherein said outfeed conveyor at said third working station on which the group of first articles that are removed from a box are conveyed away from said machine is displaced longitudinally along said box conveyor from said infeed conveyor for second articles to create a clear space between the outfeed and article infeed conveyors to provide for the article handling heads to pass through said clear space free of interference.

5. Apparatus according to claim 1 wherein empty boxes and boxes containing first articles to be withdrawn from boxes, respectively, are conveyed to and arrive in proximity with said machine adjacent each other on longitudinally adjacent areas, respectively, of said box conveyor, said article infeed conveyor for second articles is aligned with the box conveyor (7) and said outfeed conveyor (10) is aligned with said box conveyor laterally of said infeed conveyor for second articles and the outfeed conveyor is longitudinally spaced from where the empty boxes and the boxes containing first articles arrive in proximity to the machine.

6. Apparatus according to any one of claims 1, 2, 3, 4 or 6 in which each article handling head (1) has mounted on it first and second groups (13,14) of gripping elements (2) and the groups of gripping elements are controllable independently of each other to provide for one group being controlled to grip articles and the other group being controlled to release articles.

7. Apparatus according to claim 1 wherein said closed loop path (30) of transport of the article handling heads (1) lies in a vertical plane to provide for the heads to be transported over the infeed and outfeed conveyors (9,10) and the box conveyor (7,8).

8. Apparatus according to claim 1 wherein the machine transporting the article handling heads (1) is arranged adjacent only one side of said infeed and outfeed conveyors (9,10) and the box (7,8) conveyor with the heads (1) projecting laterally of the conveyors so that there is clear access on the other side of the conveyors to said conveyors and heads.

9. The apparatus according to any one of claims 1, 2, 3, 4, 5, 7 or 8 wherein said first articles are empty bottles and said second articles are filled bottles.

10. The apparatus according to claim 6 wherein said first articles are empty bottles and said second articles are filled bottles.

* * * * *